US008534389B2

(12) United States Patent
Gallifet et al.

(10) Patent No.: US 8,534,389 B2
(45) Date of Patent: Sep. 17, 2013

(54) METHOD AND APPARATUS FOR REDUCING LUBRICANT PRESSURE PULSATION WITHIN A ROTARY CONE ROCK BIT

(75) Inventors: Thomas Gallifet, Garland, TX (US); David Harrington, Dallas, TX (US)

(73) Assignee: Varel International, Ind., L.P., Carrollton, TX (US)

( * ) Notice: Subject to any disclaimer, the term of this patent is extended or adjusted under 35 U.S.C. 154(b) by 335 days.

(21) Appl. No.: 13/016,399

(22) Filed: Jan. 28, 2011

(65) Prior Publication Data

US 2012/0193150 A1 Aug. 2, 2012

(51) Int. Cl.
*E21B 10/22* (2006.01)
*E21B 10/25* (2006.01)

(52) U.S. Cl.
USPC ..... 175/371; 384/95

(58) Field of Classification Search
USPC ..... 175/356, 371, 372, 359; 384/92, 384/93, 94, 95
See application file for complete search history.

(56) References Cited

U.S. PATENT DOCUMENTS 3,476,446 A * 11/1969 Neilson ..... 384/95
3,746,405 A 7/1973 Welton
3,844,363 A * 10/1974 Williams, Jr. ..... 175/227
3,866,695 A 2/1975 Jackson
3,890,018 A * 6/1975 Clamon ..... 384/92
3,923,108 A * 12/1975 Williams, Jr. ..... 175/227
4,019,785 A * 4/1977 Stinson et al. ..... 384/93
4,061,376 A 12/1977 Villaloboz
4,244,430 A * 1/1981 Raiburn ..... 175/227
4,572,306 A 2/1986 Dorosz
4,657,091 A * 4/1987 Higdon ..... 175/229
4,765,205 A * 8/1988 Higdon ..... 76/108.2
5,360,076 A 11/1994 Kelly, Jr. et al.
6,170,582 B1 1/2001 Singh et al.
7,237,627 B2 7/2007 Richman et al.
2005/0045387 A1 3/2005 Oliver et al.
2005/0077087 A1 4/2005 Richman et al.
2005/0183888 A1 8/2005 Dick et al.
2006/0096782 A1 5/2006 Neville et al.
2009/0205873 A1 8/2009 Dick et al.

OTHER PUBLICATIONS

International Search Report and Written Opinion mailed May 7, 2012 for PCT/US2011/059189 (9 pages).

* cited by examiner

*Primary Examiner* — Kenneth L Thompson
(74) *Attorney, Agent, or Firm* — Gardere Wynne Sewell LLP; Andre M. Szuwalski

(57) ABSTRACT

A drill tool includes a bit body, at least one bearing shaft extending from the bit body and a cone mounted for rotation on the bearing shaft. An outer bearing surface of the bearing shaft includes a non-loading zone. A first groove and a second groove are formed in the outer bearing surface at the non-loading zone. The first and second grooves are both circumferentially offset from each other and axially offset from each other. One or more of the grooves includes an opening for making a fluid connection to an internal lubricant channel within this bearing shaft. The circumferential and axial offsetting of the first and second grooves define a plurality of attenuation zones that function to restrict propagation of a cone pumping pressure pulse towards a sealing system of the drill tool.

27 Claims, 5 Drawing Sheets

METHOD AND APPARATUS FOR REDUCING LUBRICANT PRESSURE PULSATION WITHIN A ROTARY CONE ROCK BIT

TECHNICAL FIELD

The present invention relates generally to rock bit drilling tools, and more specifically concerns roller cone drilling tools and the lubrication and pressure compensation systems used within such roller cone drilling tools.

BACKGROUND

A roller cone rock bit is a commonly used cutting tool used in oil, gas, and mining fields for breaking through earth formations and shaping well bores. Reference is made to FIG. 1 which illustrates a cross-sectional view of a portion of a typical roller cone rock bit. FIG. 1 specifically illustrates the portion comprising one head and cone assembly of the bit. The general configuration and operation of such a bit is well known to those skilled in the art.

The head 10 of the bit includes a downwardly and inwardly extending bearing shaft 12. A cutting cone 14 is rotatably mounted on the bearing shaft 12. The bearing system for the head and cone assembly that is used in roller cone rock bits to rotatably support the cone 14 on the bearing shaft 12 typically employs either rollers as the load carrying element (a roller bearing system) or a journal as the load carrying element (a friction bearing system). FIG. 1 specifically illustrates a friction journal bearing implementation including a bearing system defined by a first cylindrical friction bearing 16 (also referred to as the main journal bearing). The cone 14 is axially retained on the bearing shaft 12, and further supported for rotation, by a set of ball bearings 18 provided within an annular raceway 20. The bearing system for the head and cone assembly further includes second cylindrical friction bearing 22, first radial friction (thrust) bearing 24 and second radial friction (thrust) bearing 26.

The bearing system for the head and cone assembly of the bit is lubricated and sealed. The interstitial volume within the bearing system defined between the cone 14 and the bearing shaft 12 is filled with a lubricant (typically, grease). This lubricant is provided to the interstitial volume through a series of lubricant channels 28. A pressure compensator 30, usually including an elastomer diaphragm, is coupled in fluid communication with the series of lubricant channels 28. The lubricant is retained within the bearing system by a sealing system 32 provided between the base of the cone 14 and the base of the bearing shaft 12. The configuration and operation of the lubrication and sealing systems within roller cone drill bits are well known to those skilled in the art.

A body portion 34 of the bit, from which the head and cone assembly depends, includes an upper threaded portion forming a tool joint connection which facilitates connection of the bit to a drill string (not shown, but well understood by those skilled in the art).

FIG. 2 illustrates a cross-sectional view of the bit shown in FIG. 1 focusing on a portion of the bearing system in greater detail. In particular, FIG. 2 specifically focuses on the area of the first cylindrical friction bearing (main journal bearing) 16. The first cylindrical friction bearing 16 is defined by an outer cylindrical surface 40 on the bearing shaft 12 and an inner cylindrical surface 42 of a bushing 44 which has been press fit into the cone 14. This bushing 44 is a ring-shaped structure typically made of beryllium copper, although the use of other materials is known in the art. In a roller bearing system, the outer cylindrical surface 40 on the bearing shaft 12 would interact with roller bearings maintained, for example, in an annular roller raceway within the cone 14.

FIG. 2 further shows that the ball bearings 18 ride in the annular raceway 20 defined at an interface between the bearing shaft 12 and cone 14. The ball bearings 18 are delivered to the raceway 20 through a ball opening 46, with that opening 46 being closed by a ball plug 48. The ball plug 48 is shaped to define a portion of the lubricant channels 28 within the ball opening 46. The ball bearing system as shown would typically also present in bearing system implementations which utilize roller bearings.

As discussed above, lubricant is retained within the bearing system by a sealing system 32. The sealing system 32, in a basic configuration, comprises an o-ring type seal member 50 positioned in a seal gland 52 between the cutter cone 14 and the bearing shaft 12 to retain lubricant and exclude external debris. A cylindrical surface seal boss 54 is provided at the base of the bearing shaft 12. In the illustrated configuration, this surface of the seal boss 54 is outwardly radially offset (for example, by the thickness of the bushing 44) from the outer cylindrical surface 40 of the first friction bearing 16. It will be understood that the seal boss 54 could exhibit no offset with respect to the main journal bearing 16 surface 40 if desired. The annular seal gland 52 is formed in the base of the cone 14. The gland 52 and seal boss 54 align with each other when the cutting cone 14 is rotatably positioned on the bearing shaft 12. The o-ring sealing member 50 is compressed between the surface(s) of the gland 52 and the seal boss 54, and functions to retain lubricant within the bearing system. This sealing member 50 also prevents materials in the well bore (such as drilling mud and debris) from entering into the bearing system.

Over time, the rock bit industry has moved from a standard nitrile material for the seal member 50, to a highly saturated nitrile elastomer for added stability of properties (thermal resistance, chemical resistance). The use of a sealing system 32 in rock bit bearings has dramatically increased bearing life in the past fifty years. The longer the sealing system 32 functions to retain lubricant within the interstitial volume, and exclude contamination of the bearing system, the longer the life of the bearing and drill bit. The sealing system 32 is, thus, a critical component of the rock bit.

With reference once again to FIG. 1, the second cylindrical friction bearing 22 of the bearing system is defined by an outer cylindrical surface 60 on the bearing shaft 12 and an inner cylindrical surface 62 on the cone 14. The outer cylindrical surface 60 is inwardly radially offset from the outer cylindrical surface 40 (FIG. 2). The first radial friction bearing 24 of the bearing system is defined between the first and second cylindrical friction bearings 16 and 22 by a first radial surface 64 on the bearing shaft 12 and a second radial surface 66 on the cone 14. The second radial friction bearing 26 of the bearing system is adjacent the second cylindrical friction bearing 22 at the axis of rotation for the cone and is defined by a third radial surface 68 on the bearing shaft 12 and a fourth radial surface 70 on the cone 14.

The lubricant is provided in the interstitial volume that is defined between the surfaces 40 and 42 of the first cylindrical friction bearing 16, the surfaces 60 and 62 of the second cylindrical friction bearing 22, the surfaces 64 and 64 of the first radial friction bearing 24 and the surfaces 68 and 70 of the second radial friction bearing 26. The sealing system 32 with the o-ring type seal member 50 positioned in the seal gland 52 functions to retain the lubricant within the lubrication system and specifically between the opposed radial and cylindrical surfaces of the bearing system.

During operation of the bit, the rotating cone 14 oscillates along the head in at least an axial manner. This motion is commonly referred to in the art as a "cone pump." Cone pumping is an inherent motion resulting from the external force that is imposed on the cone by the rocks during the drilling process. The oscillating frequency of this cone pump motion with respect to the head is related to the rotating speed of the bit. The magnitude of the oscillating cone pump motion is related to the manufacturing clearances provided within the bearing system (more specifically, the manufacturing clearances between the surfaces 40 and 42 of the first cylindrical friction bearing 16, the surfaces 60 and 62 of the second cylindrical friction bearing 22, the surfaces 64 and 64 of the first radial friction bearing 24 and the surfaces 68 and 70 of the second radial friction bearing 26). The magnitude is further influenced by the geometry and tolerances associated with the retaining system for the cone (for example, the ball race). When cone pump motion occurs, the interstitial volume defined between the foregoing cylindrical and radial surfaces of the bearing system changes. This change in volume squeezes the lubricant provided within the interstitial volume. The change in interstitial volume and squeezing of the lubricant grease results in the generation of a lubricant pressure pulse. Over a very short period of time, responsive to this pressure pulse, grease flows along a first path between the bearing system and the pressure compensator 30 through the series of lubricant channels 28. The pressure compensator 30 is designed to relieve or dampen the pressure pulse by compensating for volume changes through its elastomer diaphragm. However, it is known in the art that the pressure pulse, notwithstanding the presence and actuation of the pressure compensator 30, can also be felt at the sealing system 32 due to the presence of a separate second path for the flow of grease, responsive to this pressure pulse, between the opposed radial and cylindrical surfaces of the bearing system and the sealing system 32.

The flow of grease along this second path in response to the pressure pulse is known to be detrimental to seal operation and can also reduce seal life. For example, positive and negative pressure pulses due to cone pump motion may cause movement of the sealing member 50 within the seal gland. A nibbling and wearing of the seal member 50 may result from this movement. Additionally, a positive pressure pulse due to cone pump motion may cause lubricant grease to leak out past the sealing system 32. A negative pressure pulse due to cone pump motion may pull materials from the well bore (such as drilling mud and debris) past the sealing system 32 and into the bearing system.

Reference is now made to FIG. 3 which shows a cross-section of the bearing shaft 12 generally at the location of the first friction bearing 16 taken along dotted line 80 of FIG. 2. As is known by those skilled in the art, the first friction bearing 16 for the bearing system includes a loading zone (having an arc angle of about 120°-180°) which bears the load of the cone 14 and a non-loading zone (having an arc angle of about 180°-240°). The outer surface 40 of the bearing shaft 12 at the loading zone is typically hardfaced (not explicitly shown, but known to those skilled in the art). One of the lubricant channels 28 for the lubrication system terminates at the outer cylindrical surface 40 of the bearing shaft 12 in the area of the non-loading zone. The termination of the lubricant channel 28 on the outer surface 40 of the bearing shaft 12 is typically provided by a circumferentially positioned groove 90 that is milled or machined into the outer surface 40. This groove 90 includes an opening 92 for providing fluid communication into the lubricant channel 28.

Reference is now made to FIG. 4 which shows a side view of the bearing shaft 12 focusing on the non-loading zone. The circumferentially positioned groove 90 terminates the lubricant channel 28 at the outer surface 40 of the first friction bearing 16 for the bearing system using opening 92. The axial width 94 of the groove 90 spans most, but not all, of the axial width 96 of the surface 40 for the first friction bearing 16 of the bearing system. For example, the axial width 94 is typically equal to the axial width 96 minus a constant (such as twice a fraction of an inch, for example, 2*1/32" or 2*3/64". In this way, the axial width 94 is typically greater than 80-90% of the axial width 96. The groove 90 is typically axially centered with respect to the surface 40 providing two equally sized attenuation zones 100. Because of the relative widths 94 and 96, the attenuation zones 100 present a minimal amount of outer surface 40 for the first friction bearing 16 that is located axially adjacent the groove 90 and present along the path shown by arrow 98. This minimal amount of outer surface 40 is insufficient to restrict the flow of grease and the passage of a pressure pulse between the bearing system (at surfaces 60, 64 and 68) and the sealing system 32 (at surface 54) along path 98. More specifically, this minimal amount of surface 40 along the path of arrow 98 provides only two relatively short (in an axial direction) attenuation zones 100 which might assist in attenuating the flow of grease along the path of arrow 98 resulting from the axial passage of the pressure pulse. In this configuration, the pressure pulse may travel along surface 40 and reach the sealing system 32 (at surface 54) before being dampened by the pressure compensator 30. As discussed above, this pressure pulse may have detrimental effects on the sealing system 32 and particularly the sealing member 50. There is accordingly a need in the art to reduce, or eliminate, the pressure pulsation due to cone pumping from acting on the sealing system 32.

SUMMARY

A drill tool includes a bit body, at least one bearing shaft extending from the bit body and a cone mounted for rotation on the bearing shaft. An outer bearing surface of the bearing shaft includes a non-loading zone. In an embodiment, a first groove and a second groove are formed in the outer bearing surface at the non-loading zone. The first and second grooves are both circumferentially offset from each other and axially offset from each other. The circumferential and axial offsetting of the first and second grooves define a plurality of attenuation zones that function to restrict propagation of a cone pumping pressure pulse towards a sealing system of the drill tool.

In an embodiment, a drill tool comprises: a bit body; at least one bearing shaft extending from the bit body; a cone mounted for rotation on the bearing shaft; a first groove formed in a non-loading zone of an outer bearing surface of the bearing shaft; and a second groove formed in the non-loading zone of the same outer bearing surface of the bearing shaft; wherein the first groove is circumferentially offset from the second groove.

In a further embodiment, the first and second grooves are axially offset from each other on the outer bearing surface of the bearing shaft.

In an embodiment, openings are provided in the first and second grooves for fluid communication to an internal lubrication channel of the tool.

The circumferential offset of the first and second grooves provides a circumferential attenuation zone to restrict propagation of a cone pumping pressure pulse from a pressure source towards a sealing system of the drill tool.

The axial offset of the first and second grooves provides a plurality of axial attenuation zones to restrict propagation of a cone pumping pressure pulse from a pressure source towards a sealing system of the drill tool.

DETAILED DESCRIPTION OF THE DRAWINGS

Figure 5:
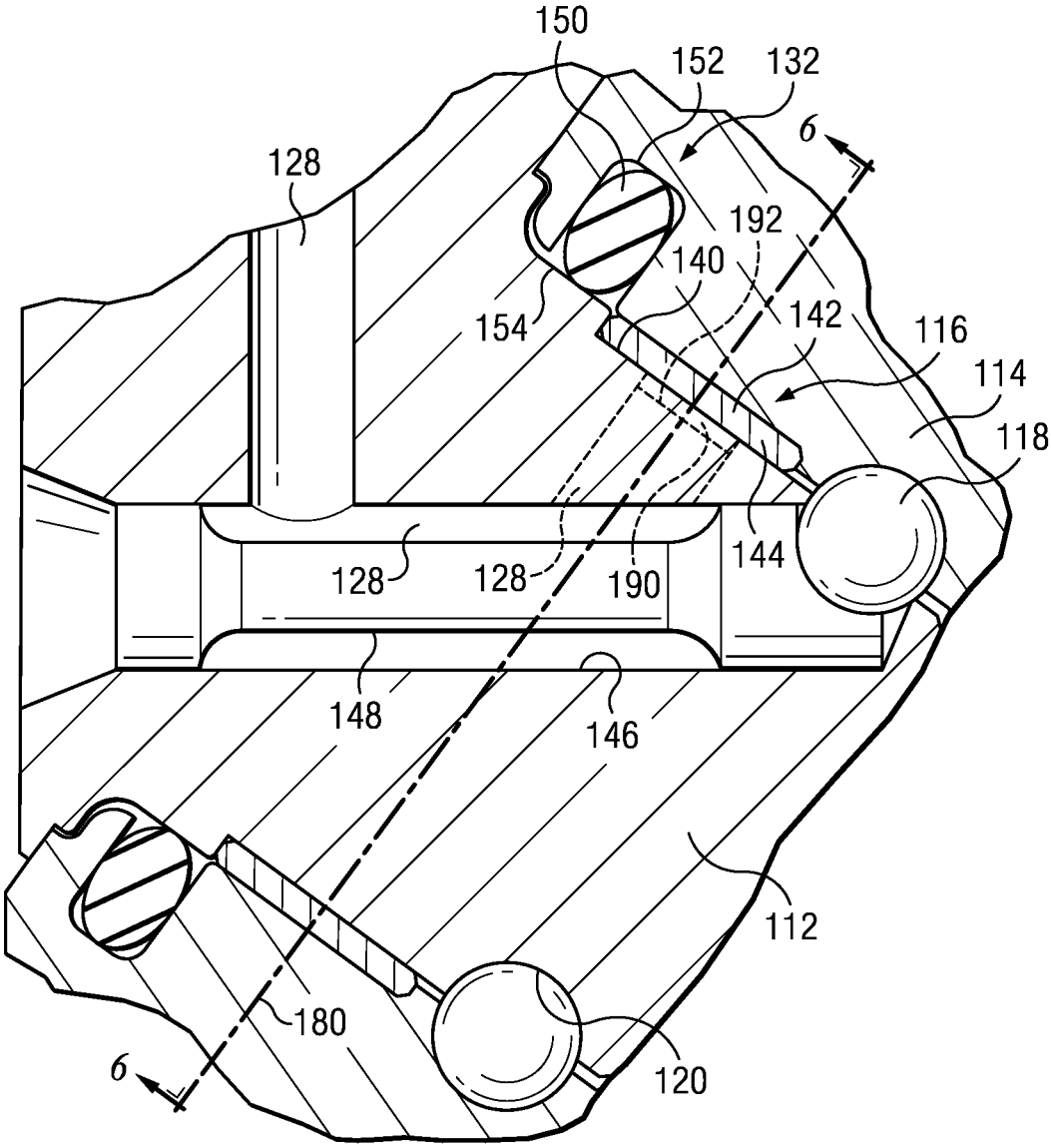
FIG. 5 illustrates a cross-sectional view of roller cone rock bit focusing on an embodiment of a bearing system in greater detail.

FIG. 5 illustrates a cross-sectional view of a roller cone rock bit focusing on an embodiment of the present invention for addressing lubricant pressure pulsation originating at the bearing system. FIG. 5 is specifically directed to the area of the cylindrical friction bearing (main journal bearing) 116. The cylindrical friction bearing 116 is defined by an outer cylindrical surface 140 on a bearing shaft 112 and an inner cylindrical surface 142 of a bushing 144 which has been press fit into a cone 114 mounted to rotate about the bearing shaft 112. The bushing 144 is a ring-shaped structure typically made of beryllium copper, although the use of other materials is known in the art. In a roller bearing system, the outer cylindrical surface 140 on the bearing shaft 112 would interact with roller bearings maintained, for example, in an annular roller raceway within the cone 114.

The bearing system further includes ball bearings 118 which ride in an annular raceway 120 defined at the interface between the bearing shaft 112 and cone 114. The ball bearings 118 are delivered to the raceway 120 through a ball opening 146, with that opening 146 being closed by a ball plug 148. The ball plug 148 is shaped to define a portion of a lubricant channel 128. The ball bearing system as shown would typically also present in bearing system implementations which utilize roller bearings.

Lubricant is provided in the interstitial volume between the surfaces 140 and 142 of the cylindrical friction bearing 116 as well as in the annular raceway 120 and other opposed cylindrical and radial bearing surfaces (as discussed above) between the cone 114 and the shaft 112. The lubricant is retained within the bearing system by a sealing system 132. The sealing system 132, in a basic configuration, comprises an o-ring type seal member 150 positioned in a seal gland 152 between the cutter cone 114 and the bearing shaft 112 to retain lubricant and exclude external debris. A cylindrical surface seal boss 154 is provided at the base of the bearing shaft 112. In the illustrated configuration, this surface of the seal boss 154 is outwardly radially offset (for example, by the thickness of the bushing 144) from the outer cylindrical surface 140 of the first friction bearing 116. It will be understood that the seal boss could exhibit no offset with respect to the main journal bearing surface 40 if desired. The annular seal gland 152 is formed in base of the cone 114. The gland 152 and seal boss 154 align with each other when the cutting cone 114 is rotatably positioned on the bearing shaft 112. The o-ring sealing member 150 is compressed between the surface(s) of the gland 152 and the seal boss 154, and functions to retain lubricant within the bearing system. This sealing member 150 also prevents materials (drilling mud and debris) in the well bore from entering into the bearing system.

Figure 6:
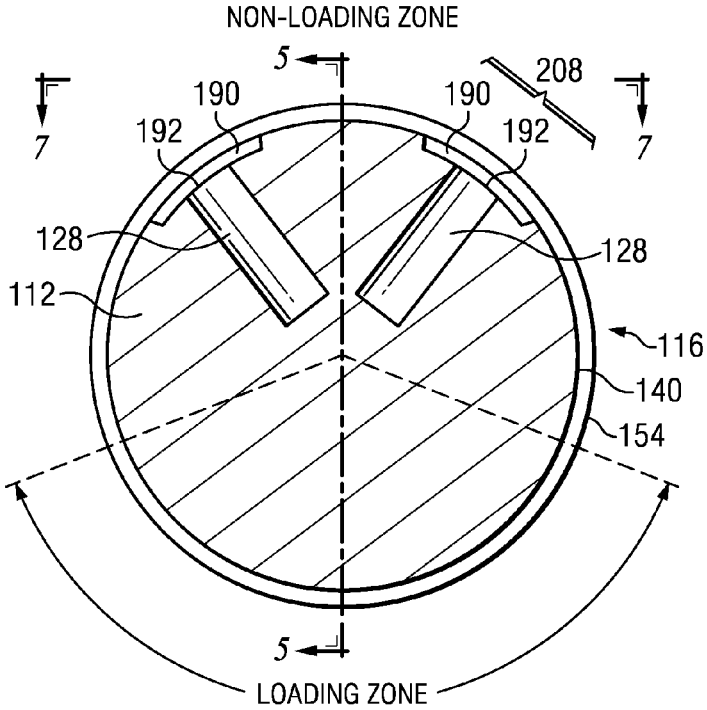
FIG. 6 illustrates a cross-section of the bearing shaft taken at the location of the dotted line in FIG. 5.

Reference is now made to FIG. 6 which shows a cross-section of the bearing shaft 112 generally at the location of the friction bearing 116 and taken along dotted line 180 of FIG. 5. The friction bearing 116 for the bearing system includes a loading zone (having an arc angle of about 120°-180°) which bears the load of the cone 114 and a non-loading zone (having an arc angle of about 180°-240°). The outer surface of the bearing shaft 112 at the loading zone is typically hardfaced (not explicitly known, but understood by those skilled in the art). At least one of the lubricant channels 128 for the lubrication system terminates at the outer surface 140 of the bearing shaft 112 in the area of the non-loading zone (in this embodiment, two such terminations are shown, but it will be understood that three or more terminations could be provided). Each termination of the lubricant channel 128 on the outer surface 140 of the bearing shaft 112 is provided at a circumferentially positioned groove 190 that is milled or machined into the outer surface 140 of the bearing shaft 112. This groove 190 includes an opening 192 into the lubricant channel 128.

FIG. 6 specifically shows the presence of two grooves 190 formed in the outer surface 140 of the bearing shaft 112. It will be understood that three or more grooves 190 could be provided. The included grooves 190 are circumferentially offset from each other (by an arc angle of between about 45-120°). Although both grooves 190 are shown to include openings 192 into the lubricant channel 128, it will be understood that this is not required. A groove 190, without an opening 192 into the lubricant channel 128, could instead be provided. Indeed, neither of the two grooves 190 of FIG. 6 is required to have an opening 192 to the lubricant channel 128 as long as some other mechanism is provided for ensuring the delivery of lubricant to the friction bearing 116.

Figure 3:
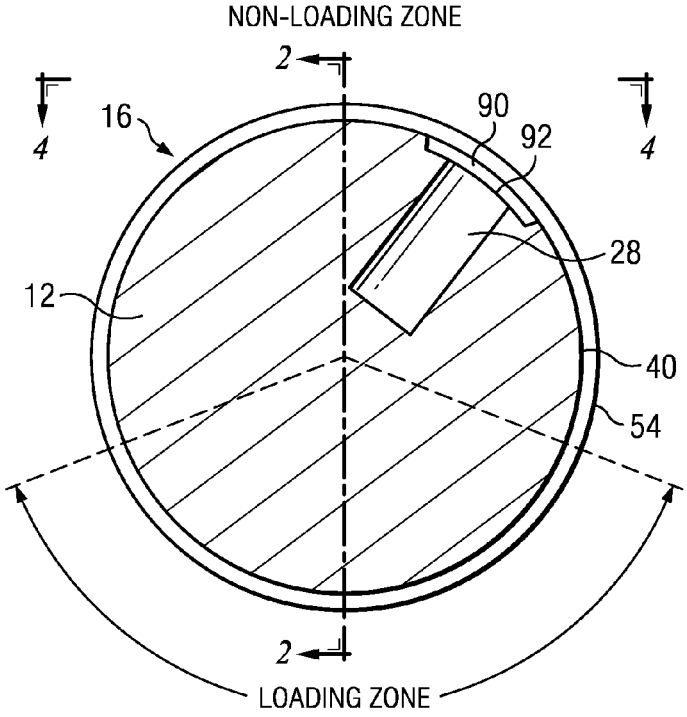
FIG. 3 (PRIOR ART)
FIG. 3 illustrates a cross-section of the bearing shaft taken at the location of the dotted line in FIG. 2.

In comparing the grooves 190 with openings 192 in FIG. 6 to the groove 90 with opening 92 in FIG. 3, it will be noted that the openings 192 in FIG. 6 into the lubricant channel 128 have a smaller diameter than the opening 92 in FIG. 3. The smaller openings 192 serve to restrict the flow of lubricant grease through the openings 192.

Although two grooves 190 are shown in FIG. 6, it will be understood that more than two circumferentially offset grooves 190 could be provided.

The circumferential length 208 of each groove 190 may, for example, extend over an arc angle of between about 10-30°, and more preferably extend over an arc angle of between about 15-20°.

Figure 4:
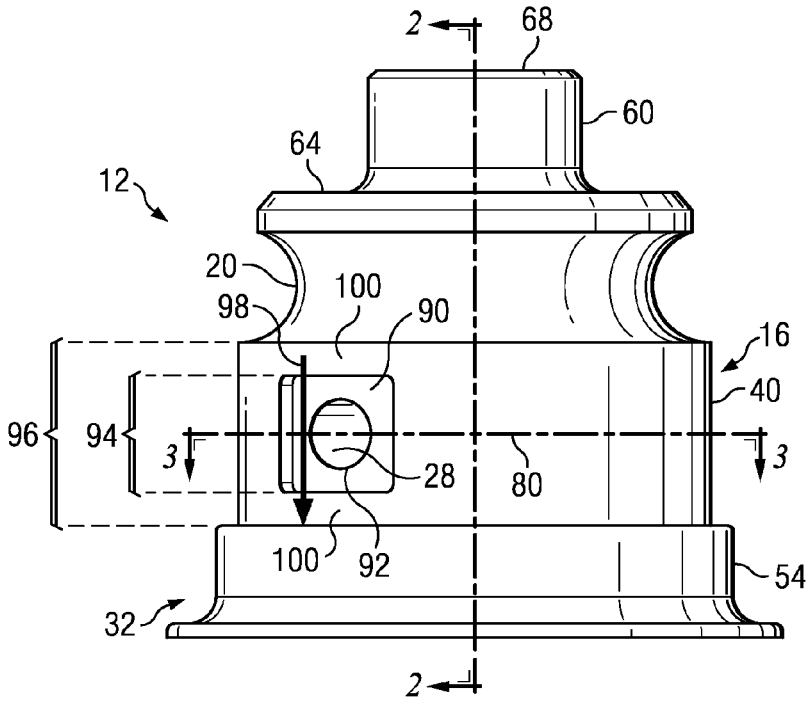
FIG. 4 (PRIOR ART)
FIG. 4 illustrates a side view of the bearing shaft of FIG. 2.
Figure 7:
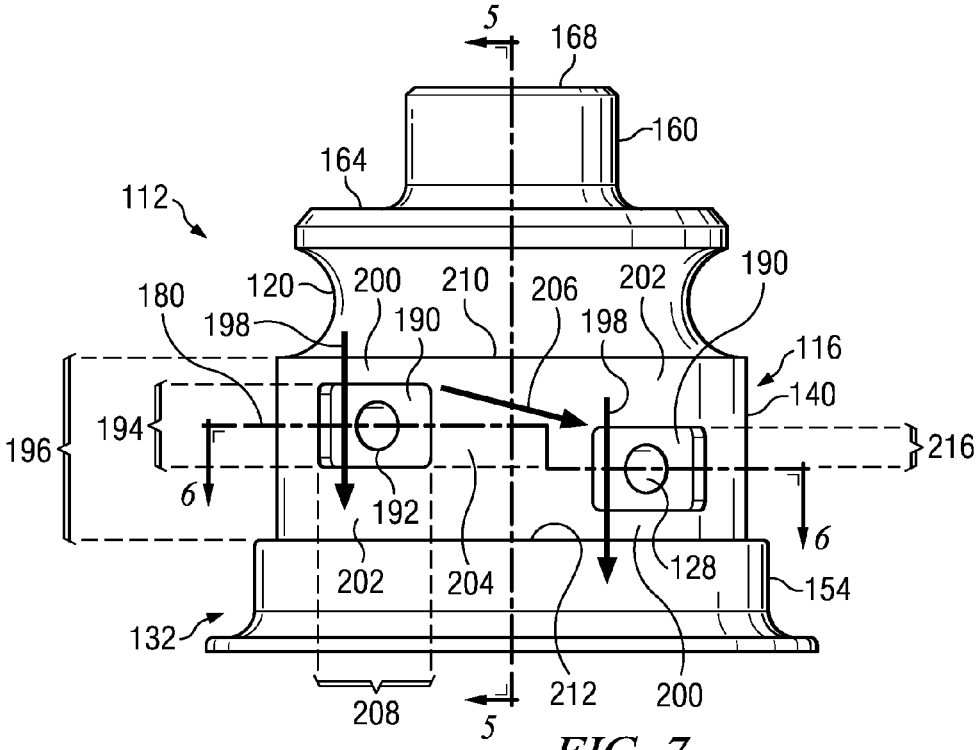
FIG. 7 illustrates a side view of the bearing shaft of FIG. 5.

Reference is now made to FIG. 7 which shows a side view of the bearing shaft 112 focusing on the non-loading zone. Each circumferentially positioned groove 190 terminates the lubricant channel 128 at the friction bearing 116 for the bearing system using an opening 192. The two grooves 190 are circumferentially offset from each other. The axial width 194 of each groove 190 is shorter than the axial width 94 of the groove 90 in FIG. 4. In a preferred embodiment, the axial width 194 of each groove 190 is no more than 70% of the axial width 196 of the friction bearing 116 for the bearing system. In a preferred implementation, a ratio of circumferential length 208 to axial width 194 of each groove 190 is between about 2-to-1 and about 4-to-1.

As discussed above, the openings 192 in FIG. 6 into the lubricant channel 128 have a smaller diameter than the opening 92 in FIG. 3. Reducing the size of the opening 192 (in comparison to the opening 92) restricts the flow of grease through the opening 192 and thus assists in attenuating the pressure pulse and grease flow associated with instances of cone pumping. In a preferred embodiment, the cross sectional area of the opening 192 is less than 150% of the annular flow area of the bearing in the vicinity of the groove 190 between the surfaces 140 and 142. Mathematically, this may be expressed as follows:

$$D \approx k*((4/\pi)*(C*L))\hat{}0.5$$

wherein: D=diameter of the opening 192; k is a constant, for example, greater than 1 such as 1.5; C=diametrical clearance of the bearing; and L=arc length of the groove 190 (see, reference 208 in FIGS. 6 and 7).

Alternatively, this may be mathematically expressed as follows:

$$D2 \leqq k*((D1+C)\hat{}2-D1\hat{}2)\hat{}0.5$$

wherein: D2=diameter of the opening 192; k is a constant, for example, a fraction less than 1 such as 0.9; D1=diameter of the shaft at the surface 140 and C=diametrical clearance of the bearing.

While reducing the diameter of the opening 192 is one preferred option, another option is to insert a choke structure (such as a choke plate or constrictor) in a larger sized opening such as the opening 92 shown in FIG. 3, this choke structure effectively providing a constricted opening in the manner described above.

Although FIG. 7 shows that each groove 190 includes an opening 192 to the lubricant channel 128, it will be understood that only one of the grooves 190 could have an opening 192, with the other groove 190 comprising a blind area formed on the bearing surface 140. Still further, it will be understood that neither of the circumferentially offset grooves 190 need have an opening 92 to the lubricant channel 128 provided some other mechanism exists for ensuring the delivery of lubricant to the friction bearing 116.

In a preferred embodiment, each opening 192 is axially offset to a position closer to one edge of the surface 140 for the friction bearing 116. In other words, the openings 192 are not axially centered on the surface 140 for the friction bearing 116. For example, the left opening 192 in FIG. 7 is shown to have an axial offset to a position closer to an upper edge 210 of the surface 140 for the friction bearing 116, while the right opening 192 in FIG. 7 is shown to have an axial offset to a position closer to an lower edge 212 of the surface 140 for the friction bearing 116. In a preferred implementation, the openings 192 are axially offset in opposite directions, as shown in FIG. 7. It will be understood, however, that both openings 192 can be axially offset towards a same edge (210 or 212) of surface 140.

Figure 1:
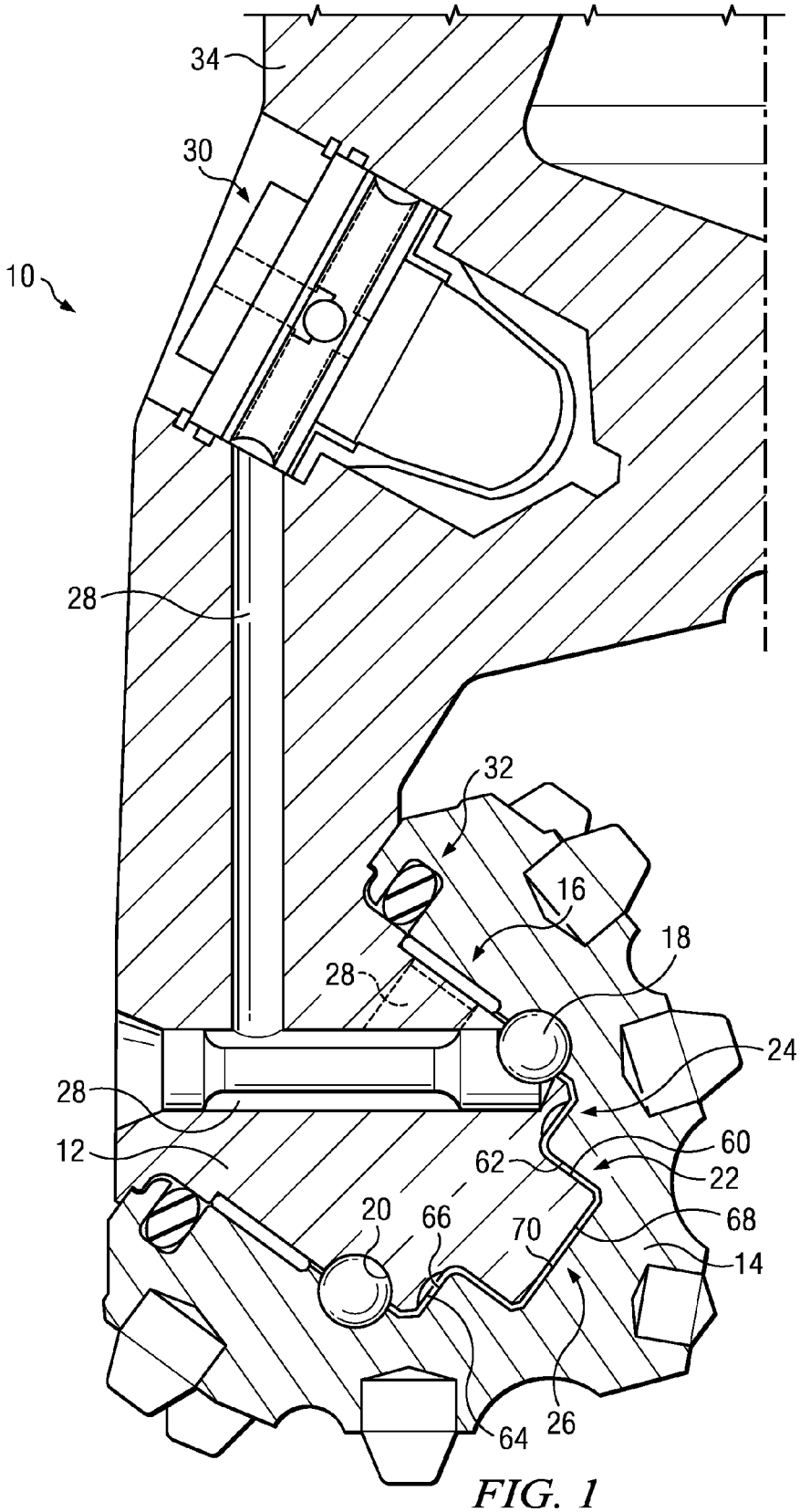
FIG. 1 (PRIOR ART)
FIG. 1 illustrates a cross-sectional view of a portion of a typical roller cone rock bit.
Figure 2:
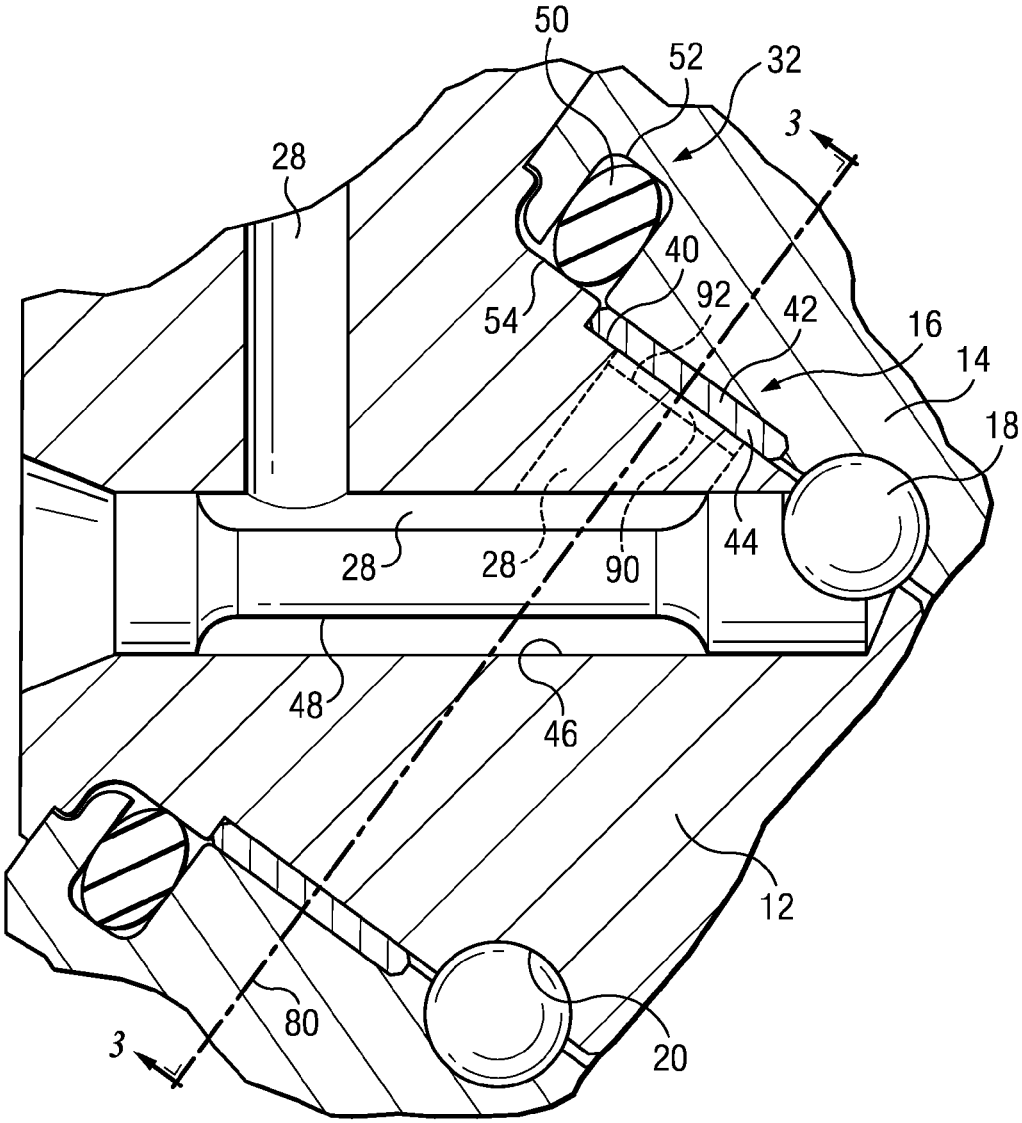
FIG. 2 (PRIOR ART)
FIG. 2 illustrates a cross-sectional view of the typical roller cone rock bit shown in FIG. 1 focusing on the bearing system in greater detail.

Axially offsetting the openings 192 in the manner described, and providing the relative widths 194 and 196, increases (in comparison to FIG. 4) the amount of outer surface 140 for the first friction bearing 116 that is axially adjacent the groove 190 and present along the paths shown by arrows 198. The increased amount of outer surface 140 better restricts the flow of grease and the passage of a pressure pulse between the bearing system (at surfaces 160, 164 and 168) and the sealing system 132 (at surface 154). As a result of the axial offset, the increased amount of surface 140 at each arrow 198 provides (in an axial direction) a relatively shorter attenuation zone 200 on one side of the groove 190 and a relatively longer attenuation zone 202 on the other side of the groove 190. This configuration with longer attenuation zones 202 provides improved performance over the configuration of FIG. 4 in terms of attenuating the flow of grease due to the axial passage of the pressure pulse. The additional attenuation resulting from the presence of the relatively longer attenuation zones 202 further assists in protecting the sealing system 132 (at surface 154) from the pressure pulse and supports the damping operation of the pressure compensator 30 (see, FIG. 1). In a preferred implementation, the ratio of axial width of the relatively longer attenuation zone 202 to the axial width of the relatively shorter attenuation zone 200 is between about 3-to-1 and about 6-to-1. It is preferred that the axial offsetting of the grooves 190 should preserve at least a small amount of circumferential axial overlap 216 between the grooves, especially in instances where one of the grooves is a blind groove without an opening 192 (but, it should also be understood that no axial overlap 206 may be necessary in some implementations).

The circumferential offset of the two grooves 190, along with the relative widths 194 and 196 and axial offset of the grooves 190, further provides an additional attenuation zone 204 circumferentially located between the two grooves 190. The degree of circumferential offset is selected such that circumferential pressure attenuation between the grooves is approximately equal to the axial pressure attenuation between a groove and a further end of the bearing. In other words, the circumferential offset of the grooves 190 is selected so that it is approximately equally difficult for the grease pressure pulse to travel between the end of the bearing system and the groove along the path of arrow 198 as it is for the grease pressure pulse to travel between grooves along the path of arrow 206. In this way, both possible paths of grease pressure travel are substantially equally attenuated.

When cone pump motion occurs, the lubricant provided in the interstitial volume bearing system (with shaft 116 surfaces 140, 160, 164 and 168) is squeezed. This results in the generation of a pressure pulse. In response to the pressure pulse, lubricant grease flows through the series of lubricant channels 28 between the bearing system and the pressure compensator 30 (see, FIG. 1). The pressure compensator 30 is designed to dampen or relieve the pressure pulse by compensating for volume changes through its elastomer diaphragm. The paths provided by arrows 198 and 206, however, are also available for grease flow in response to the pressure pulse. The attenuation zones 200, 202 and 204 are provided to restrict the flow of grease along these paths and thus reduce, or eliminate, the pressure pulsation due to cone pumping from acting on the sealing system 132.

Although FIGS. 5-7 specifically illustrate the use of a friction journal bearing system, it will be understood that the grooves 190 (with or without openings 192) could alternatively be used in connection with a roller bearing system.

Furthermore, although FIG. 5-7 specifically illustrate the provision of grooves 190 (with or without openings 192) in connection with the main bearing of the bearing system (whether journal or roller), it will be understood that the grooves 190 (with or without openings 192) could alternatively be provided in connection with any suitable bearing surface of shaft 116 (including, but not limited to, surfaces 140, 160, 164 and 168) in either a friction journal bearing or roller bearing implementation.

Although explained in the context of a drilling tool designed primarily for use in an oilfield drilling application, it will be understood that the disclosure is not so restricted and that the bearing system as described could be used in any rotary cone drilling tool including tools used in non-oil field applications. Specifically, the drilling tool can be configured for use with any suitable drilling fluid including air, mist, foam or liquid (water, mud or oil-based), or any combination of the foregoing. Furthermore, although described in the context of a solution to the problems associated with cone pumping and lubricant pressure pulsation in sealed and pressure compensated systems, the solutions described herein are equally applicable to rotary cone bits which are lubricated but do not include a pressure compensator and diaphragm system.

Although preferred embodiments of the method and apparatus of the present invention have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

What is claimed is:

1. A drill tool, comprising:

a bit body;

at least one bearing shaft extending from the bit body;

a cone mounted for rotation on the bearing shaft;

a first groove formed in a non-loading zone of an outer bearing surface of the bearing shaft; and a second groove formed in the non-loading zone of the same outer bearing surface of the bearing shaft;

wherein the first groove is circumferentially separated from the second groove by a portion of the outer bearing surface, and wherein said first and second grooves are positioned on the outer bearing surface in an axially non-symmetric manner.

2. The drill tool of claim 1, wherein the bearing shaft further includes an internal lubrication channel, and further including a first opening within the first groove, the first opening providing for fluid communication between the first groove and the internal lubrication channel.

3. The drill tool of claim 2, wherein the first opening has diameter D satisfying the following equation: $D \approx k*((4/\pi)*(C*L))^{0.5}$; wherein: k is a constant greater than one; C=diametrical clearance of the bearing; and L=arc length of the first groove.

4. The drill tool of claim 2, wherein the first opening has diameter D2 satisfying the following equation: $D2 \leqq k*((D1+C)^2-D1^2)^{0.5}$; wherein: k is a constant less than one; D1=outer surface diameter of the shaft; and C=diametrical clearance of the bearing.

5. The drill tool of claim 2, wherein the first opening has a cross sectional area that is less than 150% of an annular flow area along the outer bearing surface of the bearing shaft in a vicinity of the first groove.

6. The drill tool of claim 2, further comprising a second opening within the second groove, the second opening providing for fluid communication between the second groove and the internal lubrication channel.

7. The drill tool of claim 1, wherein the circumferential separation of the first groove from the second groove defines an attenuation zone extending circumferentially along said portion of the outer bearing surface of the bearing shaft between the first groove and second groove.

8. The drill tool of claim 7, wherein the attenuation zone between the first groove and second groove provides a circumferential attenuation length that is approximately equal to an axial attenuation length provided between either the first groove or the second groove and a further end of the outer bearing surface of the bearing shaft.

9. The drill tool of claim 1, wherein the outer bearing surface of the bearing shaft is an outer cylindrical surface.

10. The drill tool of claim 9, wherein the outer cylindrical surface is a main journal bearing surface.

11. The drill tool of claim 1, wherein the bearing shaft supports a frictional journal bearing.

12. The drill tool of claim 1, wherein the outer bearing surface of the bearing shaft is axially defined between a first edge and a second edge, and wherein said axially non-symmetric positioning of the first and second grooves positions the first groove closer to the first edge of the outer bearing surface than the second groove and positions the second groove closer to the second edge of the outer bearing surface than the first groove.

13. The drill tool of claim 12, wherein said axially non-symmetric positioning of the first and second grooves defines a first axial attenuation zone along the outer bearing surface of the bearing shaft with a first length extending between the first edge and the first groove and further defines a second axial attenuation zone along the outer bearing surface of the bearing shaft with a second length extending between the second groove and the second edge.

14. The drill tool of claim 12, wherein each of the first and second grooves has an axial dimension, and wherein the axial dimension of each of the first and second grooves is no more than 70% of an axial dimension of the outer bearing surface of the bearing shaft between the first and second edges.

15. The drill tool of claim 1, each of the first and second grooves has an axial dimension and a circumferential dimension, and wherein a ratio of circumferential dimension to axial dimension of each of the first and second grooves is between about 2-to-1 and about 4-to-1.

16. The drill tool of claim 1, wherein axially non-symmetric first and second grooves have a circumferential axial overlap.

17. A drill tool, comprising:

a bit body;

at least one bearing shaft extending from the bit body;

a cone mounted for rotation on the bearing shaft;

a first groove formed in a non-loading zone of an outer bearing surface of the bearing shaft; and a second groove formed in the non-loading zone of the same outer bearing surface of the bearing shaft;

wherein the first groove is circumferentially offset from the second groove, wherein the outer bearing surface of the bearing shaft is a cylindrical surface axially positioned between a source of a cone pumping pressure pulse and a sealing system for the cone and bearing shaft, and wherein the first and second grooves are positioned in the non-loading zone of the outer bearing surface so as to each define a first attenuation zone and a second attenuation zone, wherein the first and second attenuation zones axially restrict propagation of the cone pumping pressure pulse towards the sealing system.

18. The drill tool of claim 17, wherein the first attenuation zone has a first axial dimension extending between a first edge of the groove and a first edge of the outer bearing surface, and wherein the second attenuation zone has a second axial dimension extending between a second edge of the groove and a second edge of the outer bearing surface.

19. The drill tool of claim 18, wherein the first axial dimension is different than the second axial dimension.

20. The drill tool of claim 19, wherein a ratio of the first axial dimension to the second axial dimension is between about 3-to-1 and about 6-to-1.

21. The drill tool of claim 17, wherein the circumferential offset of the first groove from the second groove defines a third attenuation zone extending circumferentially along the outer bearing surface of the bearing shaft between the first groove and second groove, wherein the first, second and third attenuation zones axially restrict propagation of the cone pumping pressure pulse towards the sealing system.

22. The drill tool of claim 21, wherein the third attenuation zone provides a circumferential attenuation of the cone pumping pressure pulse that is approximately equal to an axial attenuation of the cone pumping pressure pulse provided between either the first groove or the second groove and a further end of the outer bearing surface of the bearing shaft.

23. The drill tool of claim 17, wherein the first and second grooves are axially offset from each other.

24. The drill tool of claim 17, wherein the bearing shaft further includes an internal lubrication channel, and further including a first opening within the first groove, the first opening providing for fluid communication between the first groove and the internal lubrication channel and propagation of the cone pumping pressure pulse.

25. The drill tool of claim 17, wherein the sealing system comprises an annular seal gland and a seal member retained within the annular seal gland.

26. The drill tool of claim 25, wherein the seal member is an o-ring seal.

27. A drill tool, comprising:

a bit body;

at least one bearing shaft extending from the bit body;

a cone mounted for rotation on the bearing shaft;

a first groove formed in a non-loading zone of an outer bearing surface of the bearing shaft; and a second groove formed in the non-loading zone of the same outer bearing surface of the bearing shaft;

wherein the first groove is circumferentially separated from the second groove by a portion of the outer bearing surface, and wherein a center of the first groove is axially offset from a center of the second groove.

* * * * *